United States Patent [19]

Ishida et al.

[11] 4,448,158

[45] May 15, 1984

[54] THROTTLE CONTROL SYSTEM FOR INTERNAL COMBUSTION ENGINES

[75] Inventors: Tokuzi Ishida, Hamamatsu; Wataru Yamamoto, Kami, both of Japan

[73] Assignee: Suzuki Jidosha Kogyo Kabushiki Kaisha, Shizuoka, Japan

[21] Appl. No.: 430,067

[22] Filed: Sep. 30, 1982

[30] Foreign Application Priority Data

Oct. 27, 1981 [JP] Japan ..... 56-170705
Feb. 4, 1982 [JP] Japan ..... 57-15498

[51] Int. Cl.[3] ..... F02M 1/16
[52] U.S. Cl. ..... 123/179 G; 123/180 R
[58] Field of Search ..... 123/179 G, 179 R, 179 BG, 123/180 R, 180 E, 180 T

[56] References Cited

U.S. PATENT DOCUMENTS 3,934,571 1/1976 Mennesson ..... 123/180 R
4,168,680 9/1979 Kawai et al. ..... 123/389
4,172,864 10/1979 Hohsho et al. ..... 123/179 G
4,177,784 12/1979 Tatsutomi et al. ..... 123/179 G
4,186,697 2/1980 Yasuda et al. ..... 123/180 T

*Primary Examiner*—William A. Cuchlinski, Jr.
*Attorney, Agent, or Firm*—Flynn, Thiel, Boutell & Tanis

[57] ABSTRACT

A throttle valve is opened upon engine cranking through a predetermined angle by a vacuum-operated valve in response to a vacuum signal supplied thereto from a vacuum pickup port positioned downstream of the throttle valve, for assisting the engine in getting started quickly and stably. A directional control valve is actuated upon engine cranking to allow the vacuum signal to be fed to the vacuum-operated valve. The vacuum pickup port communicates with the vacuum-operated valve through vacuum passages having thermosensitive valves one openable when the engine is kept below a preset temperature and the other openable when the engine temperature is above the preset level. A pressure delay means may be connected between the vacuum pickup port and the vacuum-operated valve to delay closing of the latter after the engine cranking.

12 Claims, 5 Drawing Figures

THROTTLE CONTROL SYSTEM FOR INTERNAL COMBUSTION ENGINES

BACKGROUND OF THE INVENTION

The present invention relates to a throttle control system for an internal combustion engine, and more particularly to such a throttle control system for keeping a throttle valve open to a predetermined degree during cranking and, additionally, during a time interval subsequent to cranking.

It is known that internal combustion engines are generally difficult to start quickly and smoothly after the vehicle has run continuously for a long period of time, e.g., for 20 to 30 minutes after the engine has stopped. This difficulty arises out of the fact that the carburetor is subjected to percoration due to a high temperature of the engine causing the air-fuel mixture to be excessively rich, and such a rich air-fuel mixture cannot be ignited smoothly. Faced with such a situation, novice drivers tend to choke the engine in an attempt to get the engine started quickly, only to find themselves in greater trouble with starting the engine. There has been a need for a system which can start the engine quickly and stably even when the engine is still hot or remains cold.

SUMMARY OF THE INVENTION

It is an object of the present invention to provide a throttle control system for starting an internal combustion engine quickly and smoothly when the engine is cold and restarting the engine reliably when the engine is still hot.

Another object of the present invention is to provide a throttle control system, in an internal combustion engine having a two-barrel carburetor, for keeping a secondary throttle valve open for a certain period of time after engine cranking, to stabilize engine operation rapidly for improved engine performance.

Still another object of the present invention is to provide a throttle control system for opening a throttle valve through a predetermined angle upon engine cranking to normalize engine operation quickly until the engine reaches a preset temperature.

According to the present invention, a throttle control system for an internal combustion engine having a cylinder, comprises an intake passage having a throttle valve disposed therein for allowing a air-fuel mixture to flow in a direction into the cylinder, a vacuum-operated actuator operatively connected to the throttle valve for opening the latter through a predetermined angle in response to a vacuum signal, a vacuum pickup port opening into the intake passage downwardly of the throttle valve with respect to the direction of flow of the air-fuel mixture, a first vacuum passage communicating between the vacuum-operated actuator and the vacuum pickup port and having a first thermosensitive valve for opening the first vacuum passage when the engine is kept below a preset temperature, and a second vacuum passage communicating between the vacuum-operated actuator and the vacuum pickup port in parallel relation to the first vacuum passage, and having a second thermosensitive valve for opening the second vacuum passage when the engine is kept above the preset temperature and a directional control valve responsive to cranking of the engine for opening the second vacuum passage.

Still according to the present invention, a throttle control system in an internal combustion engine having a cylinder, comprises a primary intake passage having a primary throttle valve for supplying an air-fuel mixture to the cylinder when the engine operates under a full range of loads, a secondary intake passage having a secondary throttle valve for supplying an air-fuel mixture to the cylinder when the engine operates under relatively high loads, a vacuum-operated valve operatively connected to the secondary throttle valve for opening the latter through a predetermined angle in response to a vacuum signal, a vacuum pickup port opening into the primary intake passage, and a vacuum passageway communicating between the vacuum-operated actuator and the vacuum pickup port and having a directional control valve for opening the vacuum passageway in response to cranking of the engine and pressure delay means for delaying closing of the secondary throttle control valve after the cranking of the engine.

With the pressure delay means, the secondary throttle valve is delayed in its closing movement after cranking to start the engine at a higher idling speed with a relatively lean air-fuel mixture until the engine is put in stable operation. Thus, the engine can be rendered warm quickly for smooth starting of the car right after the engine started. Since additional air-fuel mixture is supplied into the engine cylinder through the secondary throttle valve, the ignition plug is prevented from getting wet with fuel, and the secondary intake system comes into operation under improved transient conditions.

The secondary throttle valve is also controlled for its opening motion by a thermosensitive valve or valves which allow a vacuum to be supplied to the vacuum-operated valve to actuate the secondary throttle valve for admitting additional air-fuel mixture therethrough until the engine is heated to a preset temperature. The directional control valve can also be actuated by an air conditioner switch for thereby opening the secondary throttle valve to stabilize engine idling when an air conditioner is in operation and to assist the air conditioner in being actuated reliably.

The above and other objects, features and advantages of the present invention will become more apparent from the following description when taken in conjunction with the accompanying drawings in which preferred embodiments of the present invention are shown by way of illustrative example.

DETAILED DESCRIPTION

Figure 1:
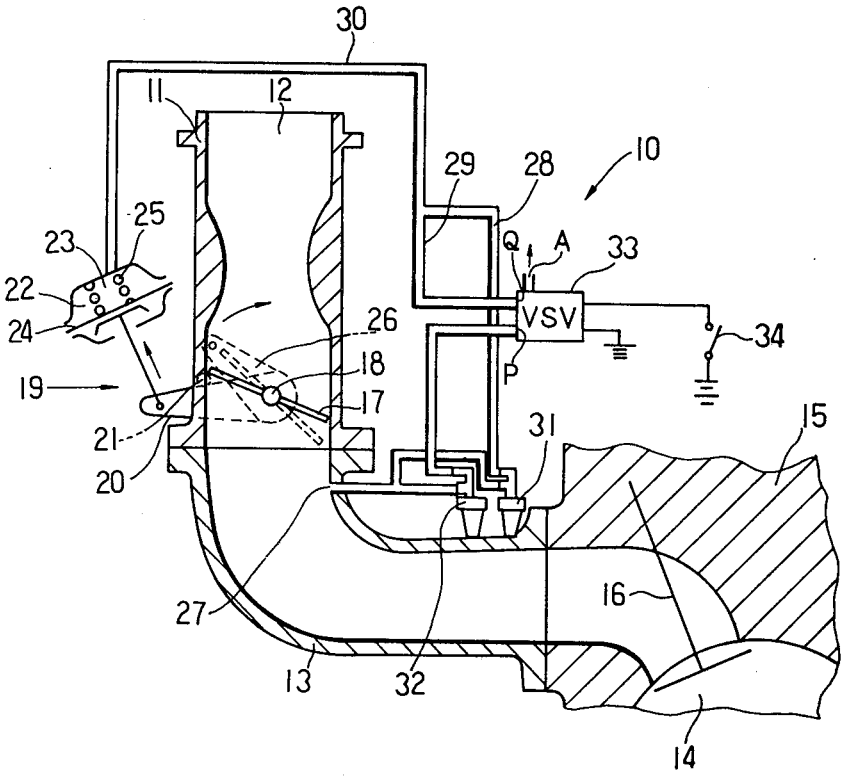
FIG. 1 is a schematic diagram of a throttle control system according to a first embodiment of the present invention, the throttle control system being associated with an intake system having a single-barrel carburetor of an internal combustion engine.

As shown in FIG. 1, a throttle control system 10 according to a first embodiment is incorporated in an intake system including a single-barrel carburetor 11 having an intake passage 12 which is connected to an intake manifold 13. An air-fuel mixture flows from the intake passage 12 through the intake manifold 13 into a combustion chamber 14 defined in an engine cylinder block 15 in which an intake valve 16 is supported.

A throttle valve 17 is pivotably mounted by a pivot shaft 18 in the intake passage 12. The throttle valve 17 is operatively connected to a link mechanism 19 comprising a first lever 20 attached to the pivot shaft 18 having an abutment pin 21, and a vacuum-operated actuator 22 having a vacuum chamber 23 and a vacuum-responsive diaphragm 24 urged by a spring 25 and operatively coupled to the first lever 20. The throttle valve 17 is also operatively connected to a second lever 26 controllable by an accelerator pedal (not shown) and engageable with the abutment pin 21. When the vacuum-operated actuator 22 operates under a vacuum developed in the vacuum chamber 23, the throttle valve 17 opens to a predetermined degree.

The intake manifold 13 has a vacuum pickup port 27 located downstream of the throttle valve 17 and held in communication with a pair of first and second parallel vacuum passages 28, 29 which are connected to a common vacuum passage 30 leading to the vacuum chamber 23 of the vacuum-operated actuator 22. The first vacuum passage 28 includes a first thermosensitive valve 31 (such as a BVSV) attached to the intake manifold 13. The first thermosensitive valve 31 serves to open the first vacuum passage 28 when the engine temperature is below a preset level, and closes the first vacuum passage 28 when the engine is heated up to the preset temperature. The second vacuum passage 29 includes a second thermosensitive valve 32 mounted on the intake manifold 13 and actuatable to open the second vacuum passage 29 when the engine temperature exceeds the preset temperature. The second vacuum passage 29 also has a directional control valve 33 having a port A vented to atmosphere, and a pair of ports P, Q coupled to the second vacuum passage 29, the vacuum control valve 33 being coupled to an ignition switch 34. When the ignition switch 34 is turned on, that is, during cranking, the vacuum control valve 33 is actuated to close the port A and open the ports P, Q for mutual communication.

The throttle control system 10 thus constructed will operate as follows:

When the ignition switch 34 is turned on for cranking while the engine is cool or its temperature is below the preset level, a vacuum is developed downstream of the throttle valve 17 and reaches the first and second thermosensitive valves 31, 32 through the vacuum pickup port 27. Since the engine temperature is lower than the preset value, the first thermosensitive valve 31 is open and the second thermosensitive valve 32 remains closed. Therefore, the vacuum is delivered through the first vacuum passage 28 and the common vacuum passage 30 to the vacuum-operated actuator 22, whereupon the first lever 20 is pulled up to open the throttle valve 17 through a prescribed angle. The throttle valve 17 remains open until the engine is heated to the preset temperature. With the throttle valve 17 thus opened slightly, the engine can rotate at higher RPM during idling and hence can quickly reach the state in which the engine will rotate stably.

Internal combustion engines are at times required to be restarted while the engine temperature is higher than the preset level. When the ignition switch 34 is switched on for cranking to restart the engine which remains hot, a vacuum is developed downstream of the throttle valve 17 and delivered through the vacuum pickup port 27 and the second thermosensitive valve 32 which is now open to the port P of the vacuum control valve 33. Since the vacuum control valve 33 is being actuated in response to turn-on of the ignition switch 34, the vacuum is allowed to pass through the port Q and the common passage 30 to the vacuum chamber 22 of the vacuum-operated actuator 22. The vacuum-operated actuator 22 is actuated to enable the link mechanism 19 to open the throttle 17 to the predetermined degree. As the throttle valve 17 opens, it introduces air into the carburetor 11 to thereby lean out the air-fuel mixture which has been enriched due to percoration until an ignitable air-fuel mixture ratio is reached. Therefore, the engine which has been heated can be restarted more easily and can quickly be brought into the stage in which the engine rotates stably. The throttle control system is advantageous in that it can improve fuel economy, cut down on unnecessary consumption of battery power, and increase the service life of the engine and accessories thereof.

When the ignition switch 34 is not subjected to cranking while the engine is hot, the ports P, Q of the directional control valve 33 are held out of communication, and hence the vacuum-operated actuator 22 is not operated.

Figure 2:
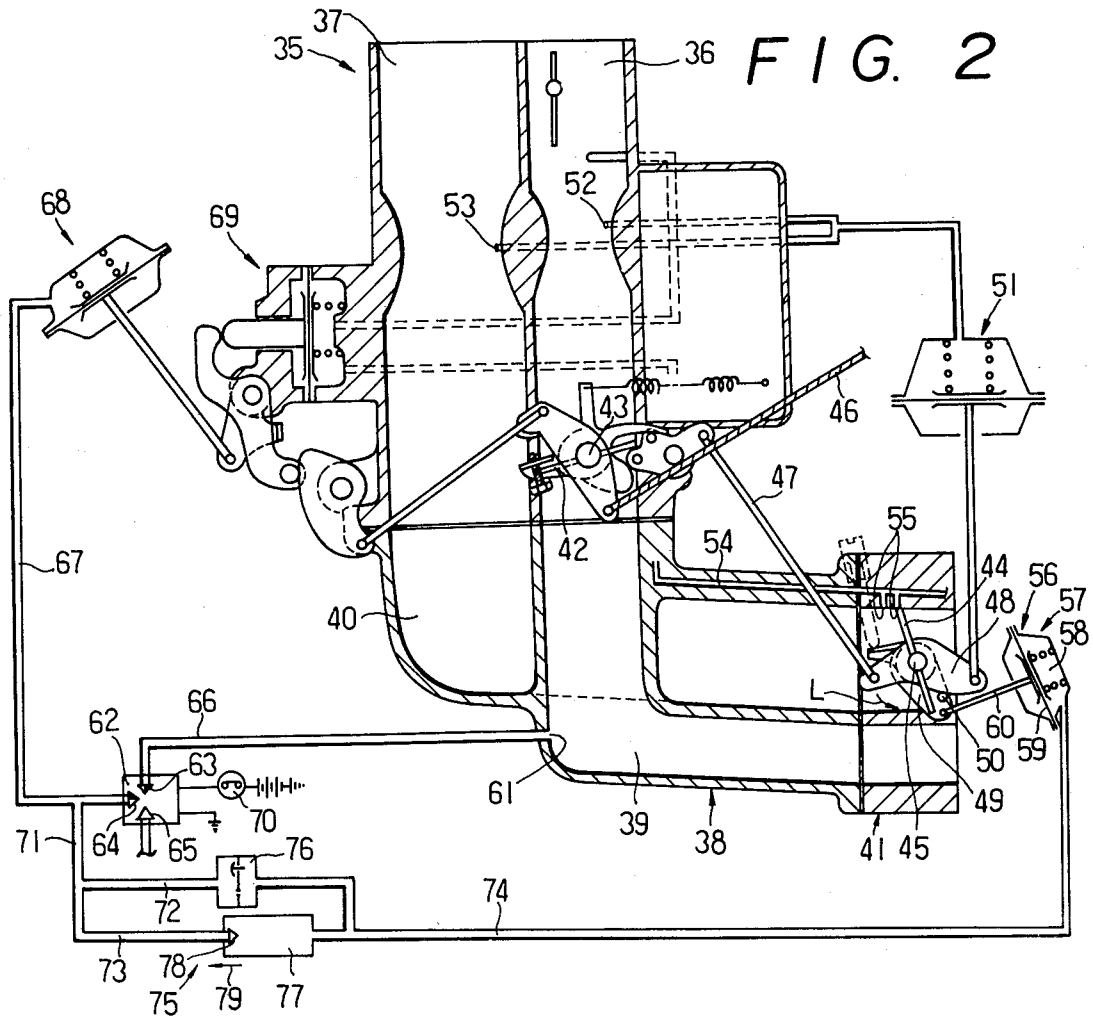
FIG. 2 is a schematic diagram of a throttle control system according to a second embodiment of the present invention, the throttle control system being incorporated in an intake system having a two-barrel carburetor of an internal combustion engine.

FIG. 2 illustrates a throttle control system according to a second embodiment of the present invention. The throttle control system shown is associated with a two-barrel carburetor 35 including a primary intake passage 36 and a secondary intake passage 37. The carburetor 35 is followed by an intake manifold 38 having a primary intake passage 39 and a secondary intake passage 40 which are connected to the primary and secondary intake passages 36, 37, respectively. The primary and secondary intake passages 39, 40 of the intake manifold 38 extend through a throttle valve block 41 for connection to a cylinder block (not shown). A primary throttle valve 42 is pivotably mounted by a shaft 43 in the primary intake passage 36 of the carburetor 35. A secondary throttle valve 44 is pivotably mounted by a shaft 45 in the secondary intake passage 40 in the throttle valve block 41. During operation of the internal combustion engine, the primary throttle valve 42 operates in a full range of engine loads, and the secondary throttle valve 44 gets into operation when the engine undergoes higher loads.

The primary throttle valve 42 is operatively connected by a connector wire 46 to an accelerator pedal (not illustrated) and by a connector rod 47 to the secondary throttle valve 44. The secondary throttle valve 44 is provided with a pair of first and second levers 48, 49 fixedly and rotatably, respectively, mounted on the shaft 45, the second lever 49 having an abutment pin 50 engageable with the first lever 48. The first lever 48 is operatively coupled with a vacuum-operated actuator 51 which will operate under a vacuum picked up at ports 52, 53 opening in the primary and secondary intake passages 36, 37, respectively, of the carburetor 35.

The intake manifold 38 has in a wall thereof a secondary slow passage 54 having secondary slow ports 55, 55 opening into the secondary intake passage 40 just upstream of the secondary throttle valve 44 as it is fully closed.

The secondary throttle vavle 44 is also operatively connected to a valve opener 56 which serves to open the secondary throttle valve 44 to a predetermined degree when the engine is under a low load, especially during cranking and idling, for stabilizing rotation of the engine. The valve opener 56 comprises a vacuum-operated valve 57 having a vacuum chamber 58 and a diaphragm 59 connected via a connector rod 60 to the second lever 49 attached to the secondary throttle valve 44. When the vacuum-operated actuator 57 is operated in response to a vacuum developed in the vacuum chamber 58, the connector rod 60 is retracted to turn the second and hence first levers 48, 49 counterclockwise in the direction of the arrow L until the secondary throttle valve 44 is opened through the predetermined angle.

A vacuum pickup port 61 opens into the primary intake passage 39 of the intake manifold 38 downstream of the primary throttle valve 42. The vacuum pickup port 61 is held in communication with a vacuum control valve or directional control valve 62 having ports 63, 64 and 65, the port 63 communicating with the vacuum pickup port 61 through a first vacuum passage 66. The port 64 communicates through a second vacuum passage 67 with a vacuum-operated actuator 68 which serves to control the primary throttle valve 42 when the engine is to be started. The vacuum-operated actuator 68 is associated with an accelerator pump 69 which is actuated upon cranking to discharge fuel vapor out of the accelerator pump 69 and passages connected thereto for thereby putting an acceleration system into operation to assist the engine in getting started. The port 65 of the directional control valve 62 is vented to atmosphere. The directional control valve 62 is electrically actuated by an ignition switch 70. When the ignition switch 70 is turned on to produce a cranking signal, the ports 63, 64 are brought into mutual communication. Conversely, when the ignition switch 70 is turned off, the port 64 is disconnected from the port 63 and connected to the port 65.

A third vacuum passage 71 is branched off from the second vacuum passage 67 and connected to a pair of parallel fourth and fifth vacuum passages 72, 73 which in turn are coupled with a common sixth vacuum passage 74 that leads to the vacuum chamber 58 of the vacuum-operated actuator 57. A pressure delay assembly 75 is disposed in the fourth and fifth vacuum passages 72, 73. More specifically, the pressure delay assembly 75 comprises a vacuum delay valve 76 such as a VTV included in the fourth vacuum passage 72 and a vacuum reservoir 77 having a one-way valve 78 openable when the pressure acts in the direction of the arrow 79. The pressure delay assembly 75 serves to delay closing operation of the secondary throttle valve 44 a certain period of time after cranking has been completed, so that the secondary throttle valve 44 will remain open to a predetermined degree after the engine has started idling for keeping the engine running at a higher idling speed and getting the secondary slow fuel supply system into operation.

The throttle control system shown in FIG. 2 will operate as follows:

For cranking while the engine is still hot, the ignition switch 70 is turned on to produce a cranking signal which causes the ports 63, 64 to communicate with each other. A vacuum developed in the primary intake passage 39 downstream of the primary throttle valve 42 is picked up by the vacuum pickup port 61 and delivered through the first and third vacuum passages 66, 71 to the pressure delay assembly 75. The vacuum is stored through the one-way valve 78 into the vacuum reservoir 77 and then transmitted into the vacuum chamber 58 of the vacuum-operated actuator 57. The diapragm 59 is then drawn into the vacuum chamber 58 to thereby cause the rod 60 to turn the second lever 49 counterclockwise in the direction of the arrow L about the shaft 45. The pin 50 on the second lever 49 pushes the first lever 48 to open the secondary throttle valve 44 through a predetermined angle until the secondary slow ports 55, 55 are positioned downstream of the secondary throttle valve 44, whereupon fuel vapor produced in the secondary slow passage 54 due to percoration therein is drawn into the secondary passage 40. Accordingly, transient characteristics of the engine are improved when the secondary intake system comes into operation. With the secondary throttle valve 44 thus opened, an additional air-fuel mixture can be introduced to lean out an excessively rich air-fuel mixture generated due to percoration in the primary intake passage 36 in the two-barrel carburetor 35. The engine can therefore be reliably restarted while it is still heated at a high temperature.

When the engine is started while it is being cold, the secondary throttle valve 44 is opened slightly in the manner described above to allow fuel to be supplied from the secondary slow passage 54, thus facilitating the engine in getting started quickly.

After the cranking operation has been completed, that is, the engine has started, no cranking signal is issued from the ignition switch 70 and hence the ports 64, 65 are brought into mutual communication. Thus, the third vacuum passage 71 is vented to atmosphere to allow the atmospheric pressure to reach the pressure delay assembly 75. The atmospheric pressure is prevented by the one-way valve 78 from being directly transmitted to the vacuum reservoir 77, but is permitted to pass through the fourth vacuum passage 72 and the vacuum delay valve 76 into the vacuum reservoir 77. The vacuum in the vacuum reservoir 77 is progressively reduced, and the reduction of the vacuum in the vacuum chamber 58 of the actuator 57 is delayed for a certain interval of time. Therefore, the secondary throttle valve 44 is closed with a time delay after the cranking operation has been completed. During such a time delay, the engine remains operated at a higher idling speed with fuel vapor and fuel being continuously supplied from the secondary slow system, with the results that the engine can be started smoothly and quickly, rapidly brought into its stable operation, and operate under improved transient conditions when the secondary intake system is to start its operation.

Figure 3:
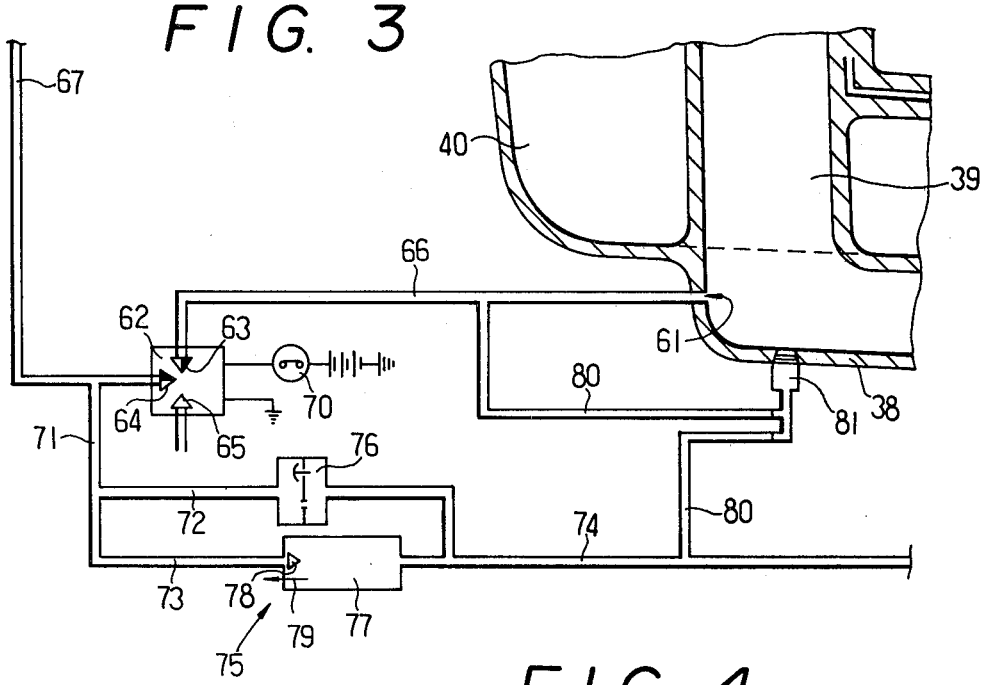
FIG. 3 is a schematic diagram of a throttle control system according to a third embodiment of the present invention.

FIG. 3 is illustrative of a throttle control system according to a third embodiment of the present invention. In FIG. 3, the first vacuum passage 66 and the sixth vacuum passage 74 are interconnected by a seventh vacuum passage 80 having therein a thermosensitive valve 81 such as a BVSV mounted on the intake manifold 38. The thermosensitive valve 81 serves to open the seventh vacuum passage 80 when the engine temperature is below a predetermined level, and to close the seventh vacuum passage 80 when the engine is heated to and above the predetermined temperature. The arrangement shown in FIG. 2 is further advantageous in that the secondary throttle valve can remain open to a predetermined degree until the engine reaches a preset temperature for stabilizing engine idling. With the engine running at a higher idling speed, the engine idling can reliably be stabilized so that the engine will be quickly brought into a stable running condition. Engine transient conditions can be improved with a sufficient amount of fuel vapor discharged from the secondary slow system.

Figure 4:
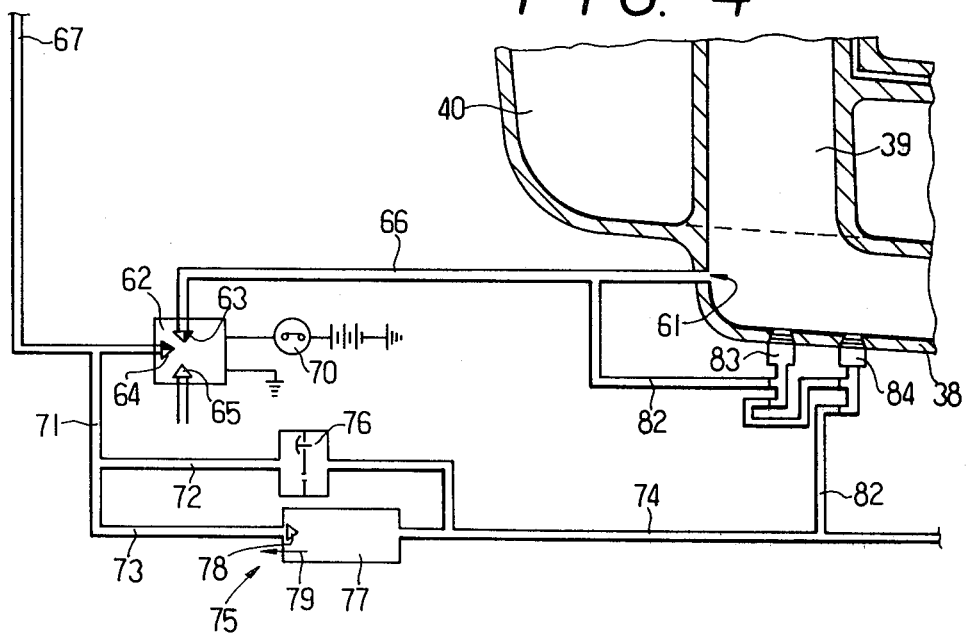
FIG. 4 is a schematic diagram of a throttle control system according to a fourth embodiment of the present invention.

According to a fourth embodiment as shown in FIG. 4, the first vacuum passage 66 and the sixth vacuum passage 74 are interconnected by a seventh vacuum passage 82 having a first thermosensitive valve 83 which serves to open the seventh vacuum passage 82 when the engine reaches a first preset temperature and a second thermosensitive valve 84 which will close the seventh vacuum passage 82 when the engine is heated to a second preset temperature. When the engine temperature reaches the first preset temperature, the first thermosensitive valve 83 is opened to transmit a vacuum to the vacuum-operated actuator for thereby opening the secondary throttle valve through a predetermined angle. When the engine is heated to the second preset temperature, the seventh vacuum passage 82 is closed by the second thermosensitive valve 84 to block the transmission of the vacuum. The secondary throttle valve will then be fully closed upon elapse of a predetermined interval of time. With this arrangement, the engine is kept running at a higher idling speed a certain period of time after the engine has been warmed. Thus, the engine operation can efficiently be stabilized rapidly with a small amount of fuel consumed.

Figure 5:
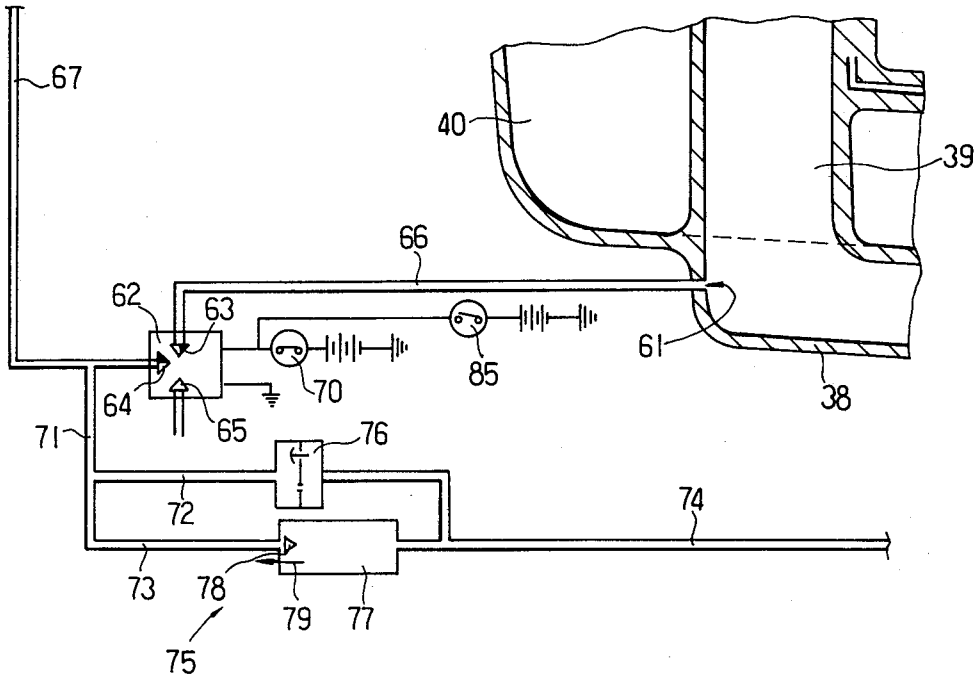
FIG. 5 is a schematic diagram of a throttle control system according to a fifth embodiment of the present invention.

A throttle control system according to a fifth embodiment as shown in FIG. 5 is substantially the same as that of the second embodiment of FIG. 2, except that the directional control valve 62 can also be controlled by an air conditioner switch 85 which is connected parallel to the ignition switch 70. In operation, when the air conditioner switch 85 is turned on, an air conditioner is energized and at the same time the ports 63, 64 of the directional control valve 62 are allowed to communicate with each other, with the consequence that a vacuum picked up by the vacuum pickup port 61 will be delivered to the vacuum-operated actuator to open the secondary throttle valve to a predetermined degree. Accordingly, the engine is caused to operate at a higher idling speed that is large enough to both energize the air conditioner and keep the engine idling stably. Such a system for putting the air conditioner and the engine under stable operation is of technical advantage as most of its entire construction doubles as the throttle control system as illustrated in FIG. 2 and hence no substantially increase in the number of parts used is required.

Although certain preferred embodiments have been shown and described in detail, it should be understood that many changes and modifications may be made therein without departing from the scope of the appended claims.

What is claimed is:

1. A throttle control system for an internal combustion engine having a cylinder, comprising:

(a) an intake passage having a throttle valve disposed therein for allowing a air-fuel mixture to flow in a direction into the cylinder;

(b) a vacuum-operated actuator operatively connected to said throttle valve for opening the latter through a predetermined angle in response to a vacuum signal;

(c) a vacuum pickup port opening into said intake passage downwardly of said throttle valve with respect to said direction of flow of the air-fuel mixture;

(d) a first vacuum passage communicating between said vacuum-operated actuator and said vacuum pickup port and having a first thermosensitive valve for opening said first vacuum passage when the engine is kept below a preset temperature; and (e) a second vacuum passage communicating between said vacuum-operated actuator and said vacuum pickup port in parallel relation to said first vacuum passage, and having a second thermosensitive valve for opening said second vacuum passage when the engine is kept above said preset temperature and a directional control valve responsive to cranking of the engine for opening said second vacuum passage.

2. A throttle control system according to claim 1, including an intake manifold communicating with said intake passage, said first and second thermosensitive valves being mounted on said intake manifold.

3. A throttle control system according to claim 1, including an ignition switch for actuating said directional control valve.

4. A throttle control system according to claim 1, including a common vacuum passage connected between said vacuum-operated actuator and said first and second vacuum passages.

5. A throttle control system in an internal combustion engine having a cylinder, comprising:

(a) a primary intake passage having a primary throttle valve for supplying an air-fuel mixture to the cylinder when the engine operates under a full range of loads;

(b) a secondary intake passage having a secondary throttle valve for supplying an air-fuel mixture to the cylinder when the engine operates under relatively high loads;

(c) a vacuum-operated actuator operatively connected to said secondary throttle valve for opening the latter through a predetermined angle in response to a vacuum signal;

(d) a vacuum pickup port opening into said primary intake passage; and (e) a vacuum passageway communicating between said vacuum-operated actuator and said vacuum pickup port and having a directional control valve for opening said vacuum passageway in response to cranking of the engine and pressure delay means for delaying closing of said secondary throttle control valve after the cranking of the engine.

6. A throttle control system according to claim 5, wherein said vacuum passageway includes a pair of parallel vacuum passages, said pressure delay means comprising a vacuum delay valve disposed in one of said vacuum passages and a vacuum reservoir disposed in the other vacuum passage and having a one-way valve openable to allow a pressure to be delivered only in a direction toward said vacuum pickup port.

7. A throttle control system according to claim 6, including an ignition switch for actuating said directional control valve, said directional control valve having first and second ports connected respectively to said vacuum pickup port and said pair of parallel vacuum passages, and a third port vented to atmosphere, said first and second ports being connectable together when said ignition switch is turned on, and said second and third ports being connectable together when said ignition switch is turned off.

8. A throttle control system according to claim 5, including a vacuum passage communicating between said vacuum pickup port and said vacuum-operated actuator in parallel relation to said vacuum passageway and having a thermosensitive valve for keeping said vacuum passage open when the engine is kept below a preset temperature.

9. A throttle control system according to claim 8, including an intake manifold through which said first and second primary and secondary intake passages extend, said thermosensitive valve being mounted on said manifold.

10. A throttle control system according to claim 5, including a vacuum passage communicating between said vacuum pickup port and said vacuum-operated actuator and having a first thermosensitive valve for opening said vacuum passage when the engine reaches a first preset temperature, and a second thermosensitive valve for closing said vacuum passage when the engine reaches a second preset temperature higher than said first preset temperature.

11. A throttle control system according to claim 10, including an intake manifold through which said first and second primary and secondary intake passages extend, said first and second thermosensitive valves being mounted on said manifold.

12. A throttle control system according to claim 5, including an air conditioner switch for actuating said directional control valve to open said secondary throttle valve through said predetermined angle in response to operation of an air conditioner.

* * * * *